US012760614B2

(12) United States Patent
Holmes et al.

(10) Patent No.: US 12,760,614 B2
(45) Date of Patent: Oct. 13, 2026

(54) SAFETY INTEGRITY LEVEL RATED CONTROLS FOR ALL-ELECTRIC BOP

(71) Applicant: Hydril USA Distribution LLC, Houston, TX (US)

(72) Inventors: John Holmes, Katy, TX (US); Amine Abou-Assaad, Spring, TX (US)

(73) Assignee: Hydril USA Distribution LLC, Houston, TX (US)

( * ) Notice: Subject to any disclaimer, the term of this patent is extended or adjusted under 35 U.S.C. 154(b) by 691 days.

(21) Appl. No.: 18/053,631

(22) Filed: Nov. 8, 2022

(65) Prior Publication Data

US 2023/0142840 A1 May 11, 2023

Related U.S. Application Data

(60) Provisional application No. 63/277,053, filed on Nov. 8, 2021.

(51) Int. Cl.
*E21B 33/064* (2006.01)
*E21B 33/035* (2006.01)

(52) U.S. Cl.
CPC ..... *E21B 33/064* (2013.01); *E21B 33/0355* (2013.01)

(58) Field of Classification Search
CPC .. E21B 33/064; E21B 33/0355; E21B 33/038; E21B 33/06; E21B 33/061; E21B 33/085; E21B 47/12
See application file for complete search history.

(56) References Cited

U.S. PATENT DOCUMENTS 8,725,302 B2 * 5/2014 Niemeyer ..... E21B 33/0355 700/282
9,863,206 B2 * 1/2018 Biester ..... E21B 34/16
11,414,949 B2 * 8/2022 Rao ..... E21B 47/14
2011/0005770 A1 1/2011 Scranton et al.
2013/0103208 A1 4/2013 Niemeyer et al.
2016/0109874 A1 4/2016 Holmes et al.
2016/0177700 A1 6/2016 Scott et al.
(Continued)

FOREIGN PATENT DOCUMENTS

CN 107002481 A 8/2017

OTHER PUBLICATIONS

International Search Report and Written Opinion in corresponding International Application No. PCT/US22/49278, dated Feb. 17, 2023 (20 pages).

(Continued)

*Primary Examiner* — Franklin D Balseca
(74) *Attorney, Agent, or Firm* — Osha Bergman Watanabe & Burton LLP

(57) ABSTRACT

A safety integrity level rated control system includes a surface control system and a subsea control system. The surface control system includes one or more remote display panels, one or more buttons operatively connected to each of the remote display panels, two main controllers connected to the remote display panels, two junction boxes, each junction box connected to one of the two main controllers, and a surface intervention system controller connected to the one or more buttons via a wiring bus. The subsea control system is connected to the surface control system by one or more umbilicals extending from the two junction boxes.

18 Claims, 9 Drawing Sheets

(56) References Cited

U.S. PATENT DOCUMENTS

| | | | | |
|---|---|---|---|---|
| 2016/0201423 | A1 | 7/2016 | Biester et al. | |
| 2018/0073320 | A1* | 3/2018 | Holmes | E21B 34/16 |
| 2019/0360295 | A1 | 11/2019 | Mantri et al. | |
| 2020/0332653 | A1 | 10/2020 | Gutierrez et al. | |
| 2021/0262312 | A1 | 8/2021 | Holmes et al. | |

OTHER PUBLICATIONS

First Office Action in corresponding Chinese Application No. 202280074454.6, dated Aug. 22, 2026 (15 pages).

* cited by examiner

SAFETY INTEGRITY LEVEL RATED CONTROLS FOR ALL-ELECTRIC BOP

BACKGROUND

Typical BOP systems are hydraulic systems used to prevent blowouts from subsea oil and gas wells. Conventional BOP equipment includes a set of two or more redundant control systems with separate hydraulic pathways to operate a specified BOP function. The redundant control systems are commonly referred to as blue and yellow control pods. In known systems, a communications and power cable sends information and electrical power to an actuator with a specific address. The actuator in turn moves a hydraulic valve, thereby opening fluid to a series of other valves/piping to control a portion of the BOP.

Many conventional BOP systems are required to be safety integrity level (SIL) compliant. In addition, most BOP systems are expected to remain subsea for up to 12 Chemical Form months at a time. In order to decrease the probability of failure on demand, BOP control valves need to be tested while they are subsea without requiring extra opening and closing cycles of the BOP or requiring additional high pressure hydraulic cycles to close the bonnets solely for testing purposes. Various types of control systems can be safety rated against a family of different standards. These standards may be, for example, IEC61511 IEC61508. Safety standards typically rate the effectiveness of a system by using a safety integrity level. The SIL level of a system defines how much improvement in the probability to perform on demand the system exhibits over a similar control system without the SIL rated functions. For example, a system rated as SIL 2 would improve the probability to perform on demand over a basic system by a factor of greater than or equal to 100 times and less than 1000 times.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a safety integrity level rated control system having a surface control system and a subsea control system. The surface control system may include one or more remote display panels, one or more buttons operatively connected to each of the one or more remote display panels, two main controllers connected to the one or more remote display panels, two junction boxes, each junction box connected to one of the two main controllers, and a surface intervention system controller connected to the one or more buttons via a wiring bus. The subsea control system may be connected to the surface control system by one or more umbilicals extending from the two junction boxes.

In another aspect, embodiments disclosed herein relate to methods that include coupling a safety integrity level rated control system to an all-electric blowout preventer stack. Such methods may include detecting, via a remote display panel, a failure in operation of a component of the all-electric blowout preventer stack, pushing a button connected to the remote display panel, wherein pushing the button generates a command, and sending the command from a surface intervention system controller to a subsea control system. A command may be received at a remote terminal unit coupled to one section of the all-electric blowout preventer stack and transmitted from the remote terminal unit to a control pod coupled to a different section of the all-electric blowout preventer stack. Methods may further include transmitting the command to a safety integrity level network switch within the control pod, transmitting the command from the safety integrity level network switch to a safety controller via black channel communications, and actuating the component based, at least in part, on the command.

In yet another aspect, embodiments disclosed herein relate to methods that include coupling a safety integrity level rated control system to an all-electric blowout preventer stack, wherein the safety integrity level rated control system has a surface control system and a subsea control system. Methods may further include creating a communication packet addressed to a component of the all-electric blowout preventer stack and transmitting the communication packet through the surface control system and the subsea control system to the component. Using such methods, a failure of the component to actuate according to the communication packet may be detected, and a command may be generated. Methods may further include transmitting the command to a remote terminal unit coupled to one section of the all-electric blowout preventer stack, transmitting the command from the remote terminal unit to a safety integrity level network switch within a control pod coupled to a different section of the all-electric blowout preventer stack, transmitting the command from the safety integrity level network switch to a safety controller via black channel communications, and actuating the component based, at least in part, on the command.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Disclosed herein are embodiments of a control system for an all-electric blowout preventer system. In one or more embodiments, the control system may include a surface control system and a subsea control system. Also disclosed herein are embodiments of a safety integrated level (SIL) rated control system for an all-electric blowout preventer stack. In contrast to conventional blowout preventer systems using hydraulics, an entire all-electric blowout preventer system, including all of the blowout preventer components and the control system components, is able to be safety rated.

Figure 1:
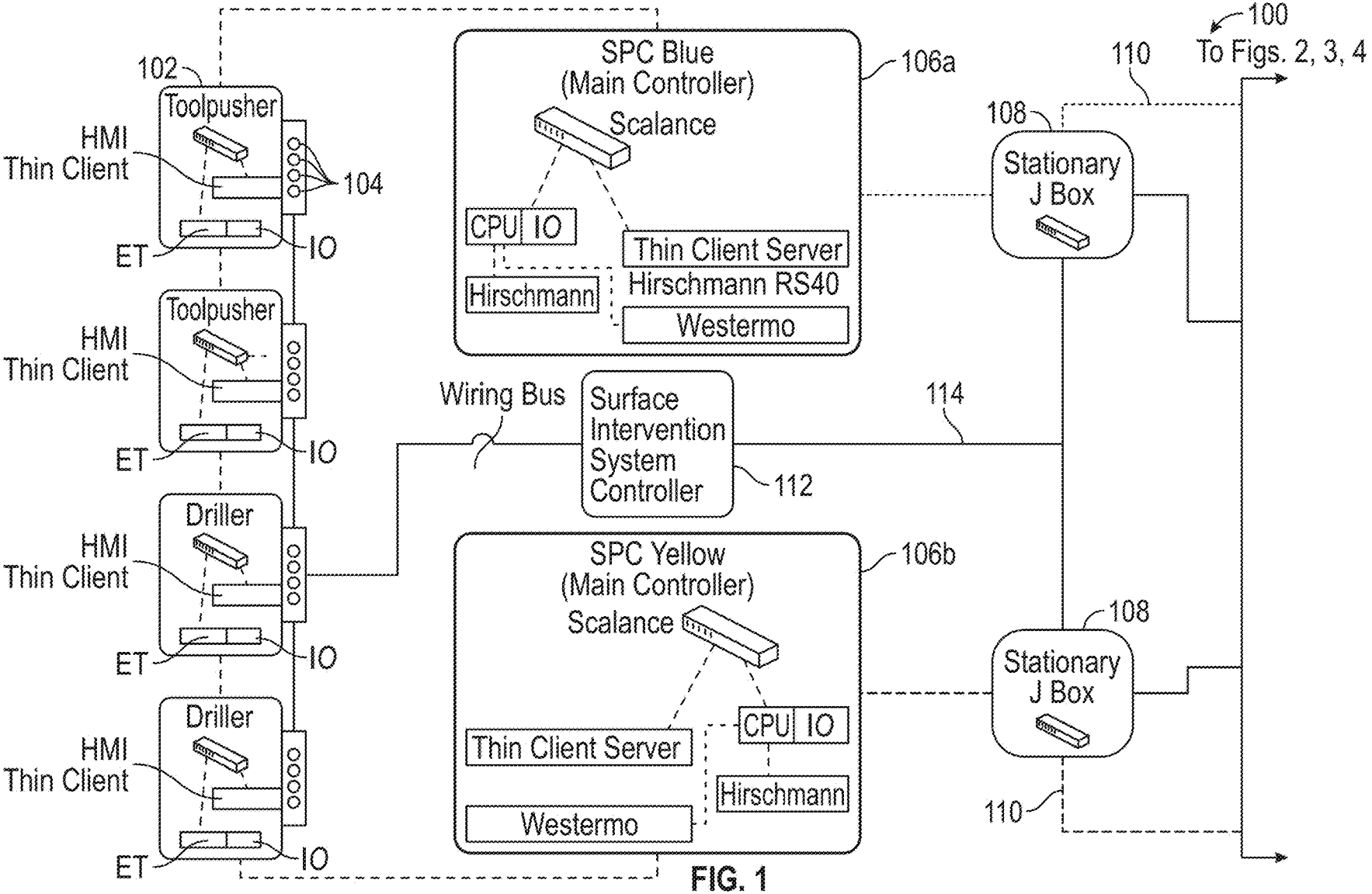
FIG. 1 shows a schematic of a surface control system for an all-electric blowout preventer in accordance with one or more embodiments.
Figure 2:
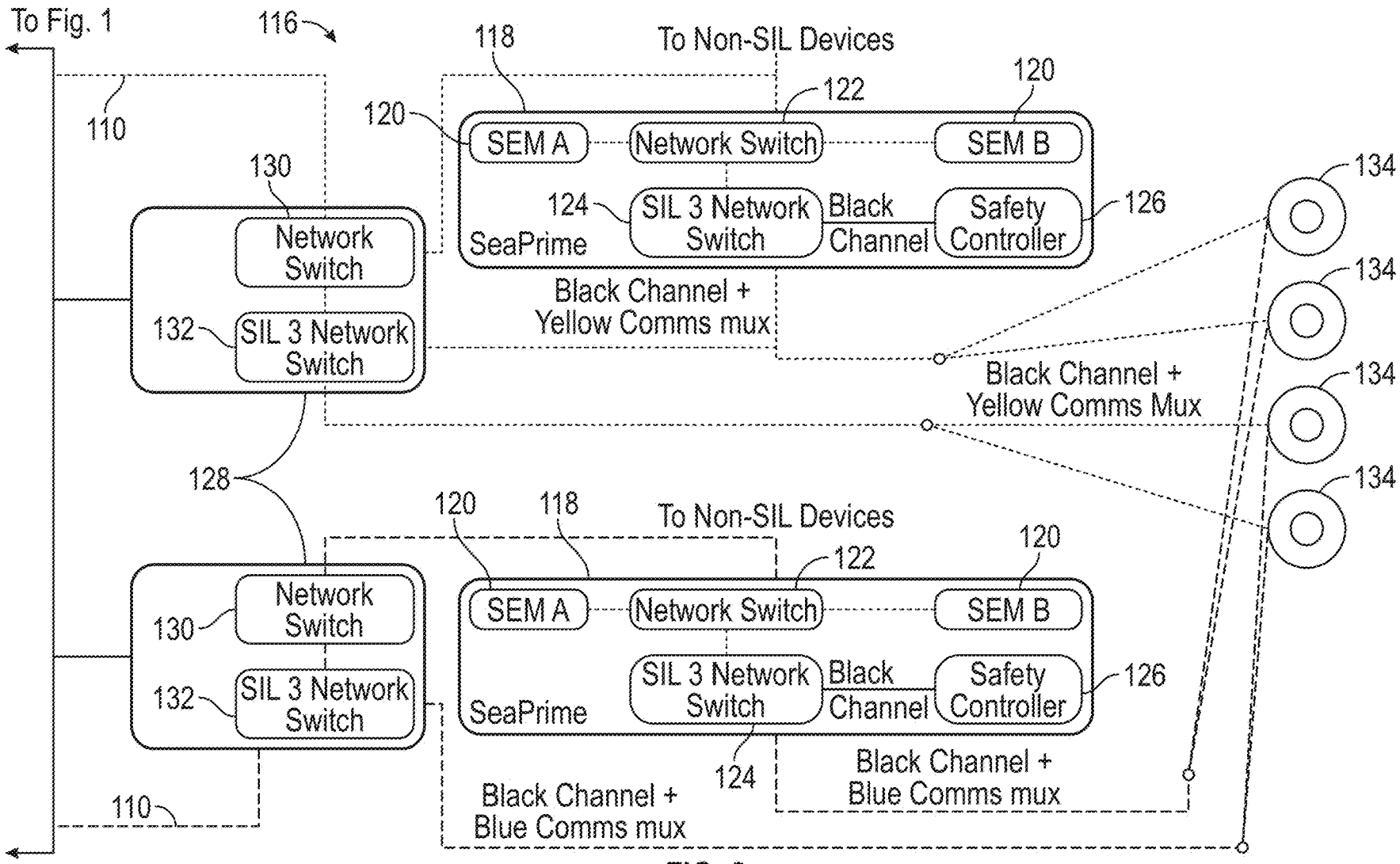
FIG. 2 shows a schematic of a subsea control system for an all-electric blowout preventer in accordance with one or more embodiments.
Figure 3:
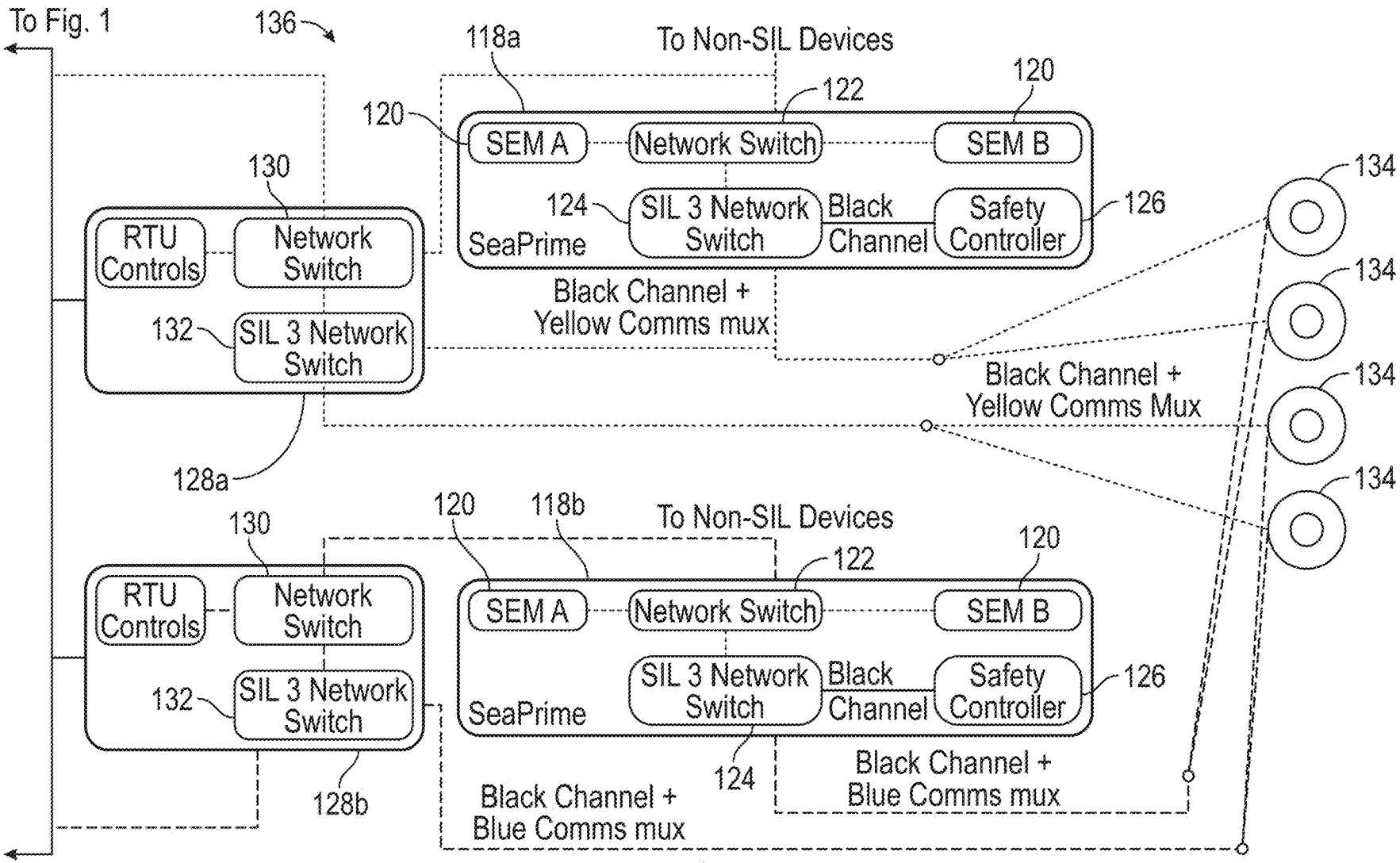
FIG. 3 shows a schematic of a subsea control system for an all-electric blowout preventer in accordance with one or more embodiments.
Figure 4:
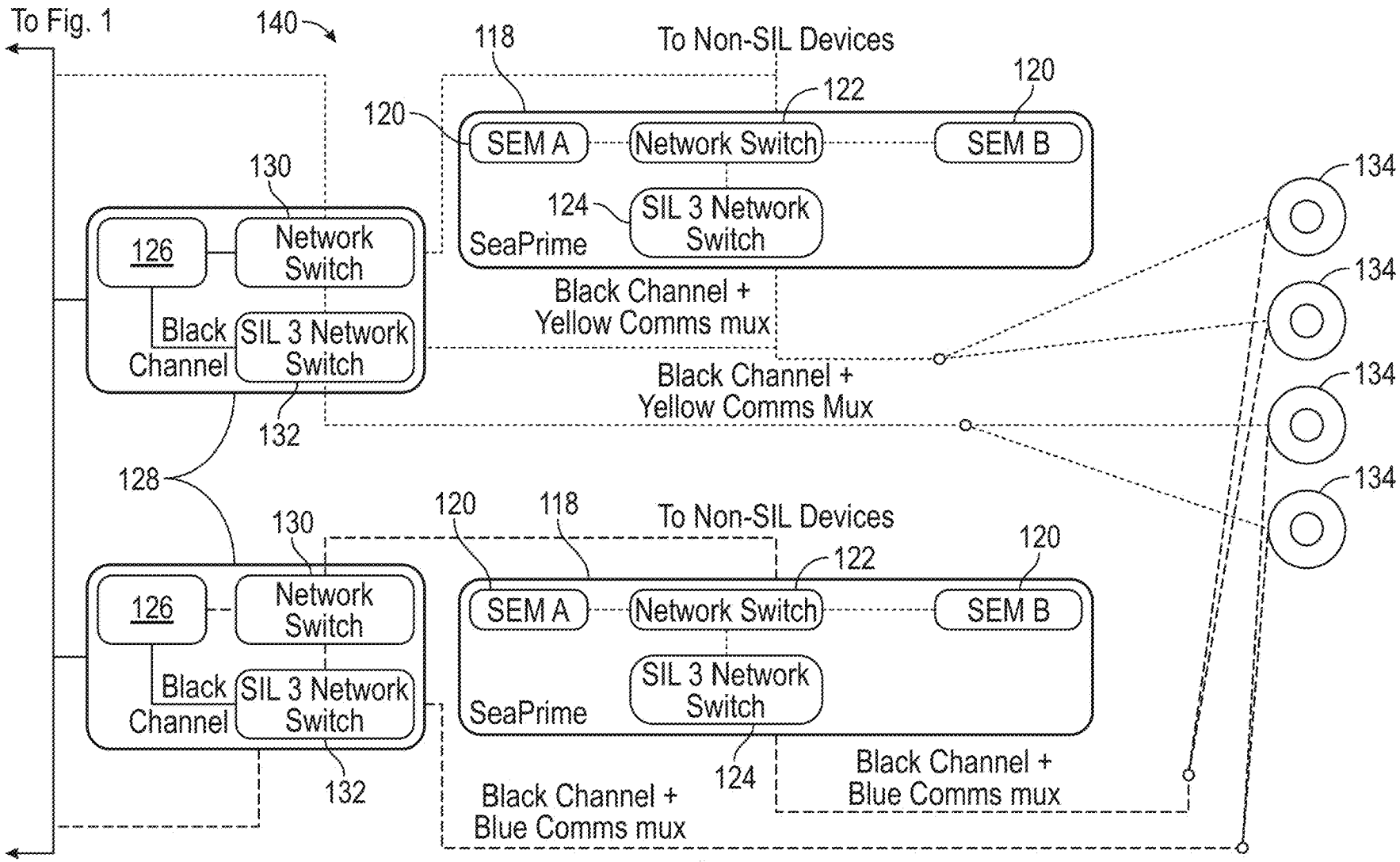
FIG. 4 shows a schematic of a subsea control system for an all-electric blowout preventer in accordance with one or more embodiments.

FIGS. 1-4 show a control system connected to an all-electric blowout preventer stack in accordance with one or more embodiments. Specifically, FIG. 1 shows a surface control system 100 and FIGS. 2, 3, and 4 show various embodiments of a subsea control system, where the surface control system and one of the subsea control systems may be combined to form the control system. The control system may also allow for the integration of a primary electric control system and a secondary electric control system, where the secondary electric control system is configured to act as a safety rated control system.

The surface control system 100 may include one or more remote display panels 102 which may be disposed on a surface facility, such as a drilling rig. In one or more embodiments, the remote display panels 102 may be touch-screens. The remote display panels 102 may be connected to two main controllers 106*a*, 106*b* (collectively 106), which may be part of the primary electric control system. In one or more embodiments, one of the main controllers 106 may be referred to as a "blue" main controller 106*b* and the second of the main controllers may be referred to as a "yellow" main controller 106*a*. Each main controller 106 may be connected to a junction box 108. Each junction box 108 may combine communication wiring (which may connect the remote display panels 102 and the main controllers 106)) and power wiring (not pictured) such that an umbilical 110 may extend from each junction box 108 to the subsea control system. In one or more embodiments, the umbilical 110 may form a conventional communication line within the primary electric control system.

One or more buttons 104 may be connected to each of the remote display panels 102 via a wiring bus and may be a part of the secondary electric control system. Each button 104 may be connected to a different component within the all-electric blowout preventer stack, such that there is a number of buttons 104 equal to the number of desired safety critical components. The one or more buttons 104 may serve as actuators for the safety rated control system. Each set of buttons 104 may be connected to a surface intervention system (SIS) controller 112. The SIS controller 112 may also be connected to each of the two junction boxes 108 via black channel communications lines 114. Black channel communication may refer to a conventionally used communication system used in safety rated control systems (e.g., as defined in International Electrotechnical Commission (IEC) 61508).

FIG. 2 shows a subsea control system 116 in accordance with one or more embodiments. The subsea control system may include two control pods 118, which may be coupled to the lower stack section of the all-electric blowout preventer stack or to the lower marine riser package (LMRP) section of the all-electric blowout preventer stack. In one or more embodiments, each control pod 118 may include two or more subsea electronics modules (SEMs) 120 (e.g., where an SEM may include firmware and hardware such as printed circuit boards to implement electronic control over one or more connected equipment units). Each control pod 118 may also include a first network switch 122 configured to connect the various components within the control pod 118 to the surface control system 100 via the umbilical 110. In one or more embodiments, the first network switch 122 and the two or more SEMs 120 may form a part of the primary electric control system.

The control pods 118 may also include components of the secondary safety rated control system. For example, each control pod 118 may include a first safety integrity level network switch 124, which may be connected to the first network switch 122, and a safety controller 126. In one or more embodiments, the first safety integrity level network switch 124 may be connected to and may communicate with the safety controller 126 via black channel communications.

In one or more embodiments, the subsea control system 116 may also include two remote terminal units 128, which may be coupled to the lower marine riser package (LMRP) section of the all-electric blowout preventer stack or to the lower stack section of the all-electric blowout preventer. A remote terminal unit may include a microprocessor-based electronic device with hardware and software components that connect data output streams to data input streams. Each remote terminal unit 128 may include a second network switch 130, which may connect the remote terminal unit 128 to the surface control system 100 via an umbilical 110. The second network switch 130, like the first network switch 122, may form part of the primary electric control system. The remote terminal unit 128 may also include a second safety integrity level network switch 132, which may form part of the secondary safety rated control system.

Each control pod 118 and remote terminal unit 128 may be connected to various components 134 of the all-electric blowout preventer stack. In one or more embodiments, components 134 of the all-electric blowout preventer stack may refer to a blind shear ram, a casing shear ram, a LMRP connector, an annular ram, frame components, or an emergency disconnect. One skilled in the art will be aware that there are many different embodiments of components 134 of the all-electric blowout preventer stack, and that the above list of examples is not exhaustive.

Figure 8:
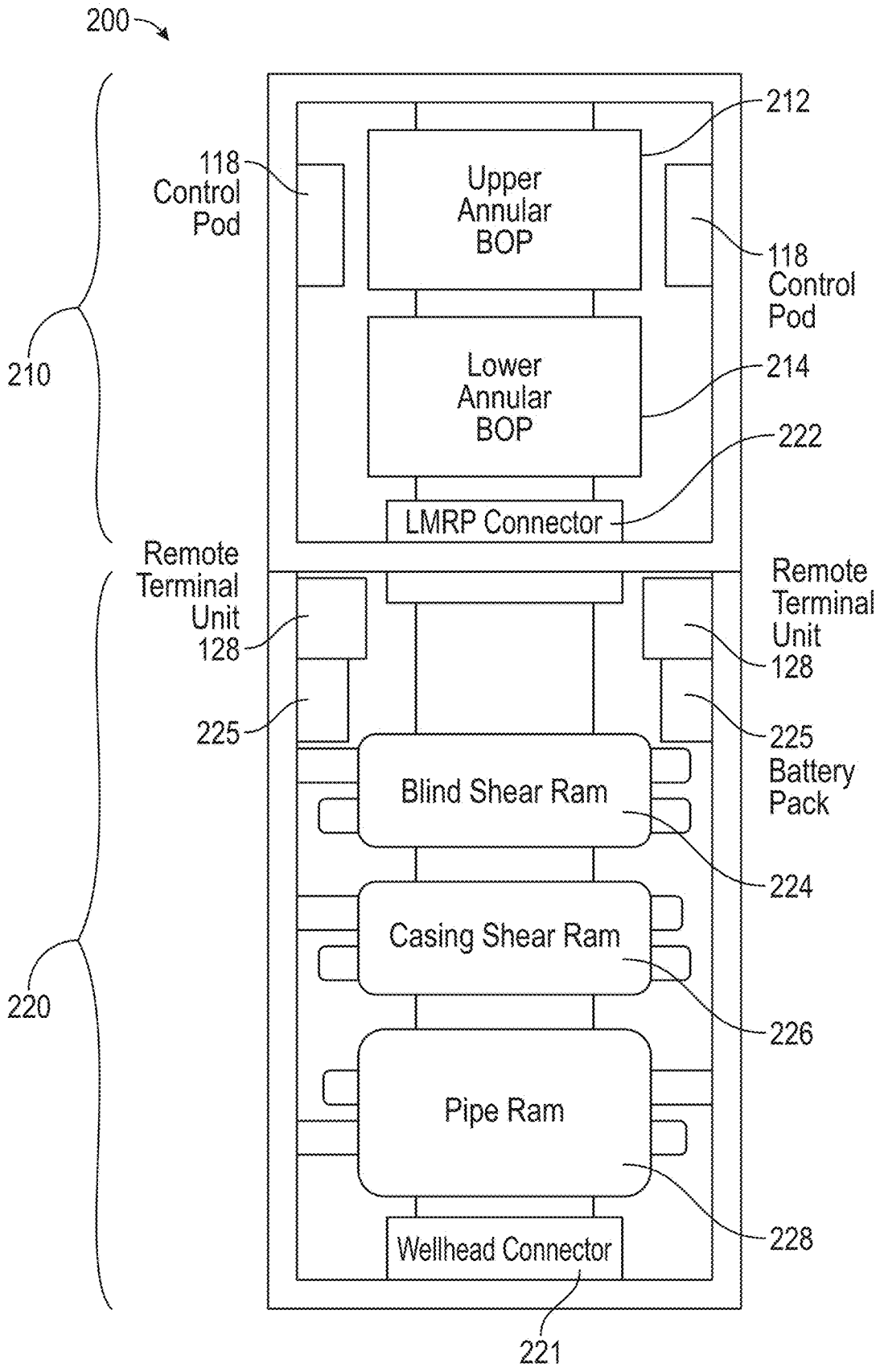
FIG. 8 shows an example of an all-electric BOP stack in accordance with one or more embodiments.

For example, FIG. 8 shows an example of an all-electric blowout preventer (BOP) stack 200 including two control pods 118, two remote terminal units 128 and various components that may be used in an all-electric BOP stack. In the embodiment shown, an LMRP 210 of the all-electric BOP stack 200 includes an upper annular BOP 212, a lower annular BOP 214, and an LMRP connector 222. The lower stack 220 in the all-electric BOP stack 200 shown includes a blind shear ram 224, a casing shear ram 226, pipe rams 228, and a wellhead connector 221. Well fluid piping and flow paths may also be provided through the LMRP and lower stack of the BOP stack. In the embodiment shown, the control pods 118 and RTUs 128 are mounted on the frame of the BOP stack. Additionally, battery packs 225 may be connected to the RTUs 128. The battery packs 225 may provide instantaneous power to the RTUs 128 sufficient to power the RTUs for an operation (e.g., to provide power for between 0.5 to 1.5 minutes to close one or more rams). The battery packs 225 may be recharged over a longer period of time via a connection to a power source at the surface. RTUs 128 and their associated batteries may be smaller than the lower stack components.

Various electrical connection lines (not shown) may be provided along the all-electric BOP stack 200 and from the BOP stack to the surface. For example, electrical lines may connect the control pods 118 to one or more of the components in the all-electric BOP stack 200 and may connect the remote terminal units 128 to one or more components in the all-electric BOP stack 200.

In the embodiment shown, the control pods 118 may be connected to the frame of the LMRP 210, and the RTUs 128 may be connected to the frame of the lower stack 220. In other embodiments, the all-electric BOP stack 200 may have control pods 118 mounted in the lower stack 220. In such embodiments, RTUs 128 and associated batteries 225 may be mounted in the LMRP 210, and power may be sent to the control pods 118 via the RTUs 128. Alternatively, in embodiments having control pods 118 provided in the lower stack 220, RTUs 128 may be omitted from the BOP stack 200, and the control pods 118 may be hard wired to the surface (e.g., via umbilical 110 in FIGS. 1-4) without use of RTUs.

The subsea control system 116 may be assembled by coupling one remote terminal unit 128 and one control pod 118 to the "yellow" communication system, which may originate from the "yellow" main controller 106*a*. The second remote terminal unit 128 and the second control pod 118 may be coupled to the "blue" communication system, which may originate from the "blue" main controller 106*b*.

FIG. 3 shows a subsea control system 136 in accordance with one or more embodiments. Similar to the subsea control system 116 shown in FIG. 2, the subsea control system 136 may be couple to the surface control system 100. The subsea control system 136 includes two control pods 118*a*, 118*b* (collectively 118) and two remote terminal units 128*a*, 128*b* (collectively 128). The first control pod 118*a* and the first remote terminal unit 128*a* may be connected to the "yellow" communication system. The second control pod 118*b* and the second remote terminal unit 128*b* may be connected to the "blue" communication system.

The control pods 118 may include two or more SEMs 120, a first network switch 122, a first safety integrity level network switch 124, and a safety controller 126. The remote terminal units 128 may include a second network switch 130 and a second safety integrity level network switch 132. Further, in the embodiment shown in FIG. 3, the remote terminal units 128 also include a remote terminal unit controller 138.

FIG. 4 shows a subsea control system 140 in accordance with one or more embodiments. In some embodiments of subsea control systems, such as subsea control system 140, the safety controller 126 may be located in the remote terminal unit 128 as opposed to the control pod 118. As such, the remote terminal units 128 may contain a safety controller 126, a second network switch 130, and a second safety integrity level network switch 132. The control pod 118 may contain two or more SEMs 120, a first network switch 122, and a first safety integrity level network switch 124.

FIGS. 2-4 show different examples of RTU and control pod configurations in a subsea control system. The different configurations shown may be used for different applications and in different BOP stack configurations. For example, when RTUs are mounted on the LMRP section of an all-electric BOP stack, the RTUs may or may not have an RTU controller 138. In some embodiments, when RTUs are mounted on the LMRP section, the RTUs could be used as a network switch only to direct communications to the annular BOPs, the connector, the lower stack, etc. In alternate embodiments, when RTUs are mounted on the LMRP section, the RTUs may include an RTU controller to provide local control of the loads. In yet other embodiments, when RTUs are mounted on the lower stack section of an all-electric BOP stack, the RTUs would include an RTU controller to provide intelligence during an autoshear or deadman event.

Figure 5A:
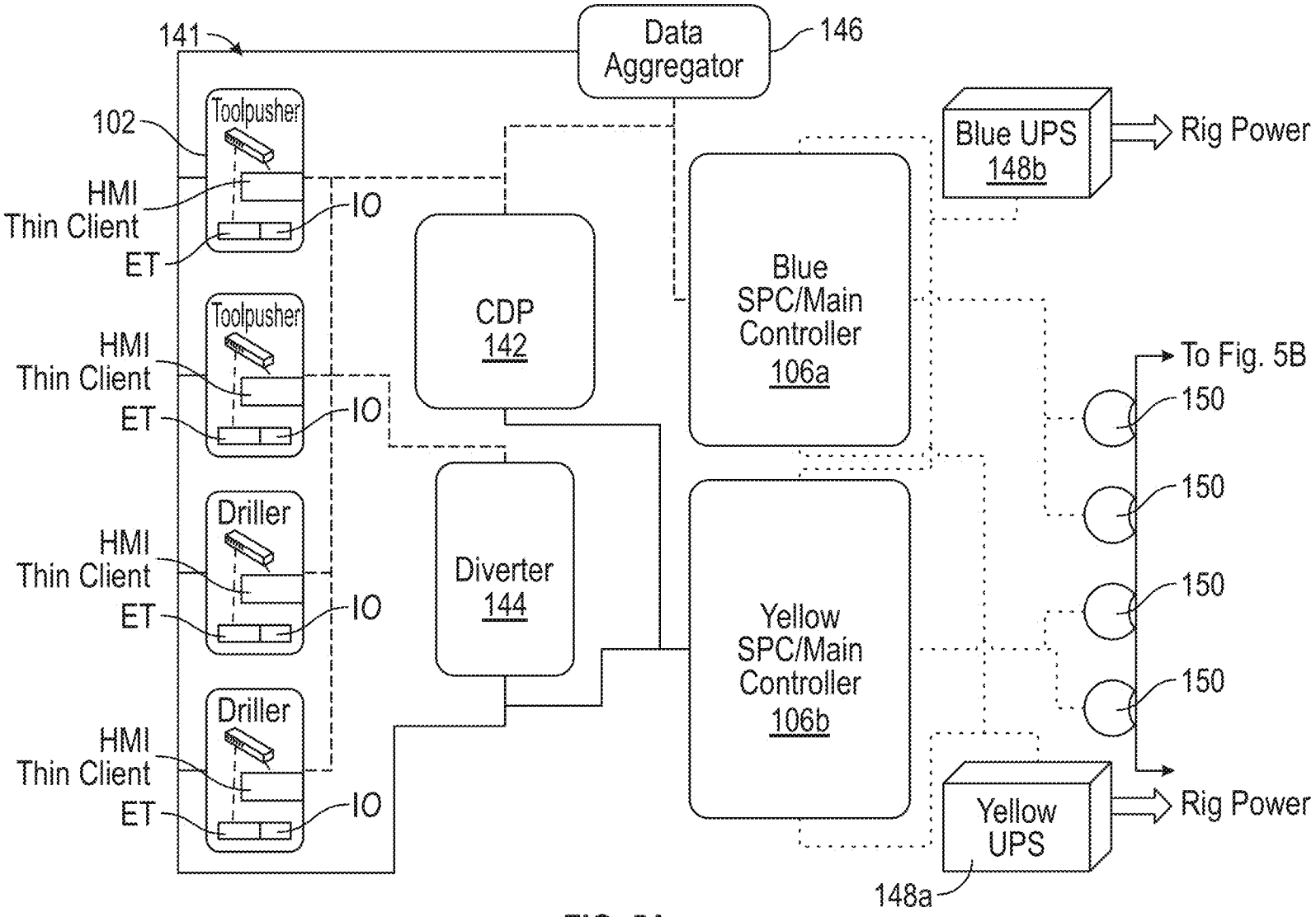
FIGS. 5A and 5B show a schematic of a power system for an all-electric blowout preventer in accordance with one or more embodiments.
Figure 5B:
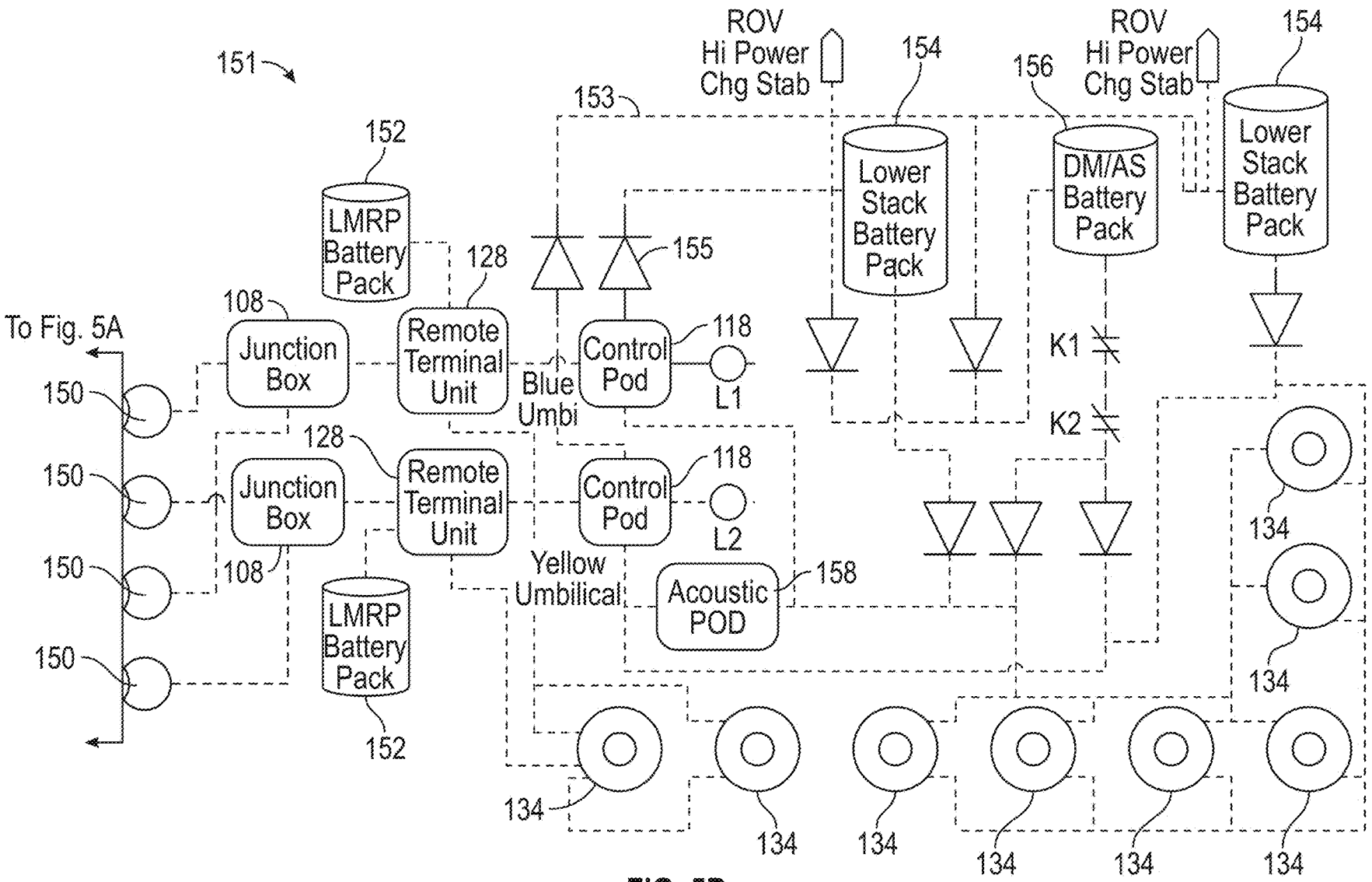

FIGS. 5A and 5B show a power system of an all-electric blowout preventer in accordance with one or more embodiments. More specifically, FIG. 5A shows a surface power system 141 and FIG. 5B shows a subsea power system 151 in accordance with one or more embodiments. In one or more embodiments, the one or more remote display panels 102 may be connected to a configuration and diagnostic panel (CDP) 142 and a diverter 144. The CDP 142 may include a human machine interface (HMI), which may show and include digital controls to control one or more processes. The diverter 144 may include one or more remote I/O (input/output) units having input and output modules (to send and receive data from a computer) installed at one end and a connection to a controller at the other end (e.g., a programmable logic controller (PLC) or central processing unit (CPU)). The diverter 144 may also include a central controller. A data aggregator 146 may also be connected to the remote display panels 102, where the data aggregator 146 operates in a demilitarized zone (DMZ) behind a firewall. The CDP 142, the diverter 144, and the data aggregator 146 may be connected to a surface power and control (SPC) unit located in the main controllers 106.

In the same way that the main controllers 106 may be referred to as the "blue" main controller 106*b* and the "yellow" main controller 106*a*, there may be two uninterruptible power supplies (UPSs) 148 which may be referred to as the "blue" UPS 148*b* and the "yellow" UPS 148*a*. In one or more embodiments, the UPSs 148 may be connected to rig power. The main controllers 106 may be connected to one or more transformers 150, which may feed into the two junction boxes 108. In one or more embodiments, the transformers 150 may step up the voltage through the system from 120V before the transformers 150 to 600V after the transformers 150.

Turning now to FIG. 5B, each junction box may be connected to a remote terminal unit 128, which forms part of subsea power system 151. Each remote terminal unit 128 may be connected to an LMRP battery pack 152 via a circuit. The LMRP battery packs 152 may include one or more batteries and a battery management system. Each remote terminal unit 128 may be connected to a control pod 118. Each control pod 118 may be connected to lower stack battery packs 154 via the circuit 153, where each lower stack battery pack 154 may include one or more batteries and a battery management system. In one or more embodiments, a diode 155 may be installed between the control pods 118 and the lower stack battery packs 154 to enable one-way flow of electricity around the circuit 153. Flow of electricity through the circuit 153 and the diodes 155 allows for charging of the one or more lower stack battery packs 154 from the surface. Further, the circuit 153 may be used to connect the surface power system 141 and the subsea power system 151 to the components 134 of the all-electric blowout preventer.

In one or more embodiments, the LMRP battery packs 152 and the lower stack battery packs 154 may be configured to power one or more motor(s) attached to the all-electric blowout preventer stack such that each component 134 in the all-electric blowout preventer may be closed without power from the surface. In one or more embodiments, a motor may produce 180 horsepower and may enable component 134 closure within 45 seconds. As such, the lower stack battery packs 154 and the LMRP battery packs 152 may store enough power to perform component 134 closure multiple times without needing to be recharged.

A battery management system (BMS), in accordance with one or more embodiments, may be integrated into the LMRP battery packs 152 and the lower stack battery packs 154. The BMS may be configured to connect to the first network switch 122 and the second network switch 130, such that the network switches 122, 130 can access and query the status of every battery in the LMRP battery pack 152 or the lower stack battery pack 154. As a result, battery failures within the packs 152, 154 may be detected and reported to the surface, specifically to the remote display panels 102, so that an operator can flag those batteries for replacement at the next available opportunity.

A deadman and autoshear (DM/AS) battery pack 156 may also be connected to the circuit 153, where the DM/AS battery pack 156 includes one or more batteries and a battery management system. The DM/AS battery pack 156 may be located in the lower stack section. In one or more embodiments, the DM/AS battery pack 156 may be used exclusively to power deadman operations or autoshear operations in emergency situations where an additional reserve store of power is required. For example, in emergency situations in which there is a failure to provide power to the all-electric blowout preventer and control systems from the surface, a deadman operation may be required. Further, in emergency situations where the LMRP section of the all-electric blowout preventer disconnects from the lower stack section and there are components 134 in open configurations, an autoshear operation in the lower stack section may be required. In one or more embodiments, if either emergency situation is detected, the DM/AS battery pack 156 may store enough energy to power all motor(s) connected to the various components 134 such that the DM/AS battery pack 156 may assist in actuating the various components 134 in the lower stack section.

In one or more embodiments, an acoustic pod 158 may also be connected to the circuit 153. An acoustic pod 158, in accordance with one or more embodiments, may refer to a device which may be dropped into the ocean from the surface facility, and which may be secured to the all-electric blowout preventer stack. The acoustic pod 158 may send acoustic signals through the water surrounding the all-electric blowout preventer, allowing it to access the blowout preventer through the safety rated control system, specifically through the first and second safety integrity level network switches 124, 132, in order to close components 134 in emergency situations. For example, in one or more embodiments, an acoustic pod 158 may be provided in the lower stack section of an all-electric BOP stack, where the acoustic pod 158 may be used to close components 134 in the lower stack section.

Figure 6:
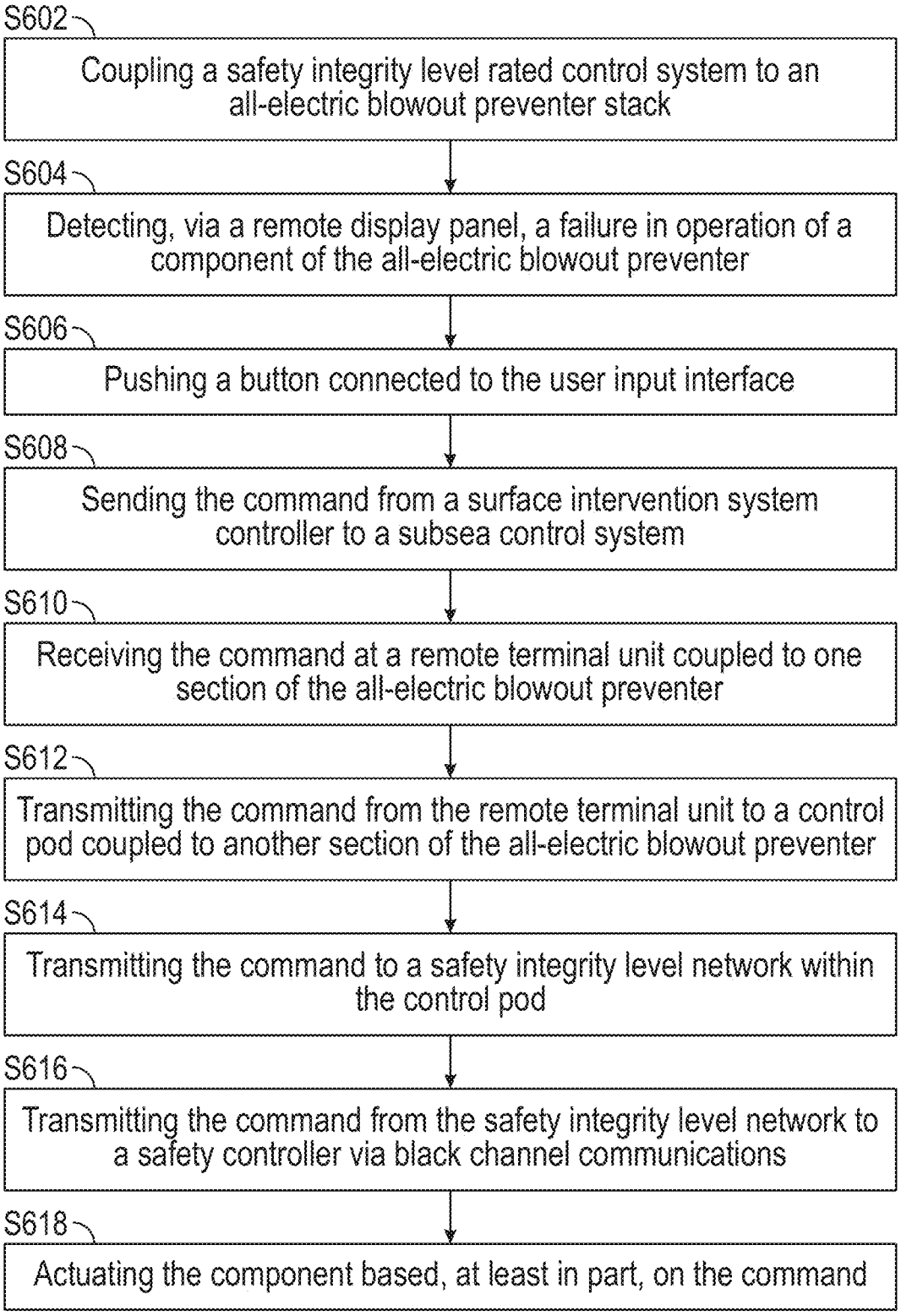
FIG. 6 shows a flowchart of a method in accordance with one or more embodiments.

FIG. 6 depicts a flowchart in accordance with one or more embodiments. More specifically, FIG. 6 depicts a flowchart 600 of a method for actuating a component of an all-electric blowout preventer via a control system. Further, one or more blocks in FIG. 6 may be performed by one or more components as described in FIGS. 1-B and 8. While the various blocks in FIG. 6 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a safety integrity level rated control system may be coupled to an all-electric blowout preventer stack, S602. In one or more embodiments, the safety integrity level control system may include a surface control system 100 and a subsea control system 116, 136, 140. A failure in operation of a component 134 of the all-electric blowout preventer may be detected via a remote display panel 102, S604. Once alerted to the component 134 failure, a user may push a button 104 connected to the remote display panel 102, where the button 104 corresponds to the failed component 134 and where pushing the button generates a command at the surface intervention system (SIS) controller 112, S606.

The command may be sent from the SIS controller 112 to the subsea control system 116, 136, 140, S608. In one or more embodiments, the command may be received at a remote terminal unit 128 coupled to one section of the all-electric blowout preventer, S610, e.g., a lower marine riser package (LMRP) section. Further, the command may be transmitted from the remote terminal unit 128 to a control pod 118 coupled to the other section of the all-electric blowout preventer, S612, e.g., a lower stack section. Specifically, the command may be transmitted to a safety integrity level network switch, such as the first safety integrity level network switch 124, within the control pod 118, S614. In one or more embodiments, the first safety integrity level network switch 124 may form a part of the safety rated control system. The command may then be transmitted from the first safety integrity level network switch 124 to a safety controller 126 via black channel communications, S616. The safety controller 126, according to one or more embodiments, may communicate with the failed component 134 via black channel communications.

As a result, the failed component 134 may be actuated based, at least in part, on the command, S618. In one or more embodiments, actuating the component 134 may include, for example, closing an open component 134, such as an open connector section, of the lower stack section of the all-electric blowout preventer. In one or more embodiments, actuating the component 134 may also involve overriding the failure in operation of the component 134.

Figure 7:
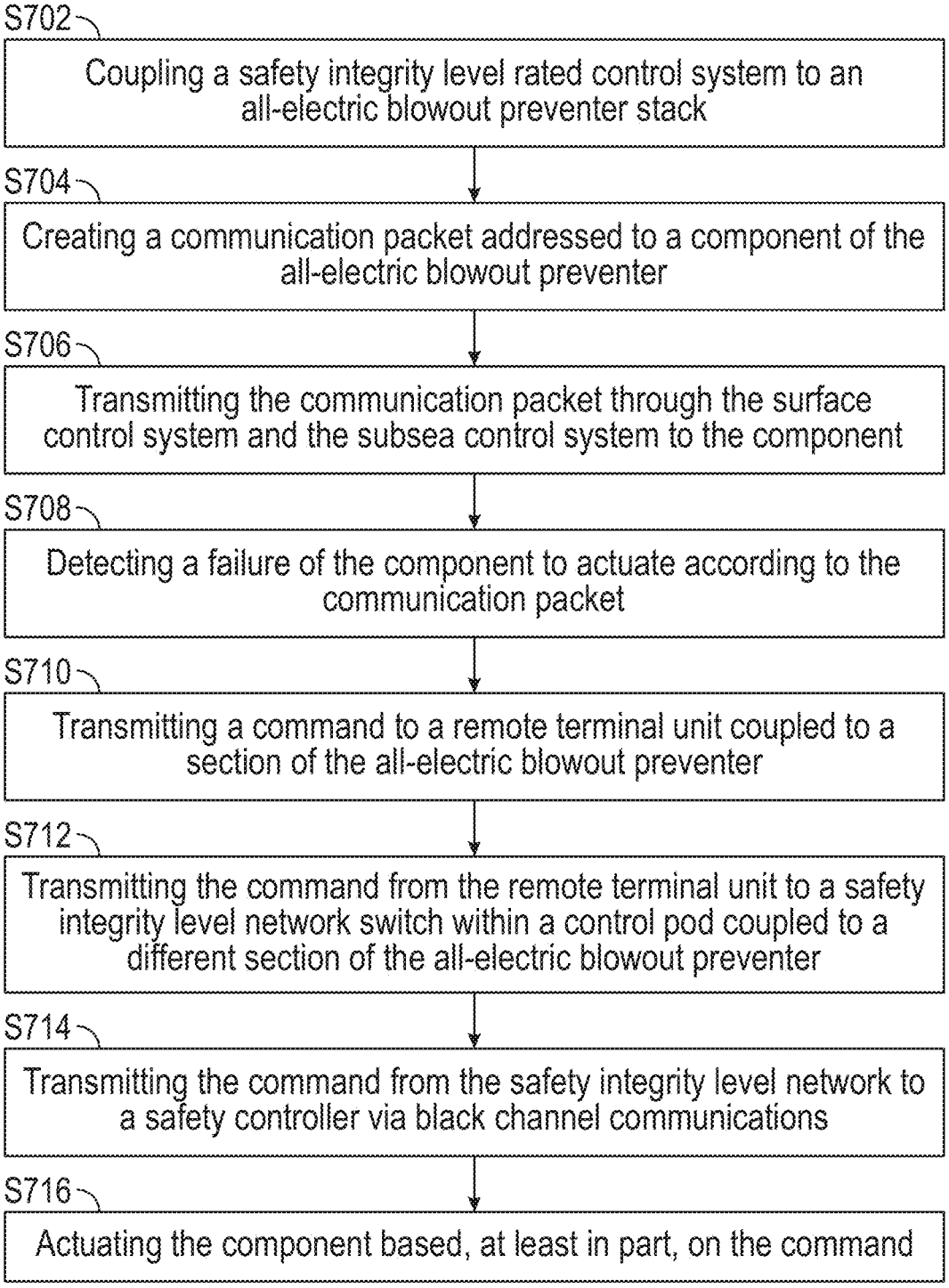
FIG. 7 shows a flowchart of a method in accordance with one or more embodiments.

FIG. 7 depicts a flowchart in accordance with one or more embodiments. More specifically, FIG. 7 depicts a flowchart 700 of a method for a method for actuating a component of an all-electric blowout preventer via a control system. Further, one or more blocks in FIG. 7 may be performed by one or more components as described in FIGS. 1-5B and 8. While the various blocks in FIG. 7 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a safety integrity level rated control system may be coupled to an all-electric blowout preventer stack, S702. In one or more embodiments, the safety integrity level rated control system comprises a surface control system 100 and a subsea control system 116, 136, 140. A communication packet addressed to a component of the all-electric blowout preventer may be created, S704. In one or more embodiments, the communication packet may include instructions for actuation of a component 134. The communication packet may be transmitted through the surface control system 100 and the subsea control system 116, 136, 140 to the component 134, S706.

In one or more embodiments, a failure of the component 134 to actuate according to the communication packet may be detected, S708. In one or more embodiments, the failure may be detected at a computer processing unit included in the two main controllers 106. In other embodiments, the failure may be detected at the remote display panels 102.

A command may be transmitted to a remote terminal unit 128 coupled to a section of the all-electric blowout preventer stack, S710, e.g., a lower marine riser package (LMRP) section or a lower stack section of the BOP stack. In one or more embodiments, the command may contain instructions for overriding the failure of the component 134 to actuate according to the communication packet. In one or more embodiments, the command may be transmitted from the remote terminal unit 128 to a safety integrity level network switch 124 within a control pod 118 coupled to a different section of the all-electric blowout preventer stack, S712, e.g., the lower stack section or the LMRP section. In other embodiments, the command may be routed to a second safety integrity level network switch 132 within the remote terminal unit 128.

The command may further be transmitted from the safety integrity level network switch, such as the first safety integrity network switch 124 and the second safety integrity network switch 132, to a safety controller 126 via black channel communications, S714. In one or more embodiments, the safety controller 126 may be located in either the control pod 118 or the remote terminal unit 128. The component 134 may be actuated based, at least in part, on the command, S716. In one or more embodiments, actuating the component 134 may include, for example, closing an open component 134, such as an open connector section, of the lower stack section of the all-electric blowout preventer.

Embodiments of the present disclosure may provide at least one of the following advantages. In currently commercially available blowout preventer systems, a safety rated control system may require hydraulic equipment in addition to electrical equipment in order. Further, since hydraulic equipment is installed in conventional blowout preventer systems, the blowout preventer, which may be referred to as the end device, is not able to be safety rated since it is outside of the electrical system. With an all-electric blowout preventer system, the entire system, including all of the blowout preventer components and the control system components, are able to be safety rated. An all-electric blowout preventer system and an all-electric control system eliminates the need for hydraulic equipment, reducing the complexity of the blowout preventer system. Accordingly, all-electric blowout preventer systems according to embodiments of the present disclosure may be lighter, smaller, and more energy efficient when compared with conventional blowout preventer systems.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A safety integrity level rated control system, comprising:

a surface control system, comprising:

one or more remote display panels;

one or more buttons operatively connected to each of the one or more remote display panels;

two main controllers connected to the one or more remote display panels;

two junction boxes, each junction box connected to one of the two main controllers; and a surface intervention system controller connected to the one or more buttons via a wiring bus;

wherein the surface control system is connected to an all-electric blowout preventer stack coupled to a subsea wellhead, and wherein the all-electric blowout preventer stack comprises a lower marine riser package (LMRP) section and a lower stack section; and a subsea control system connected to the surface control system by one or more umbilicals extending from the two junction boxes, the subsea control system comprising:

two control pods coupled to one of the lower stack section or the LMRP section, comprising:

two subsea electronics modules;

a first network switch;

a first safety integrity level network switch; and a first safety controller, wherein the first safety integrity level network switch and the first safety controller are configured to communicate with each other and a plurality of components of the all-electric blowout preventer stack via black channel communications; and two remote terminal units coupled to the other of the lower stack section or the LMRP section, comprising:

a second network switch; and a second safety integrity level network switch, wherein the second safety integrity level network switch is configured to communicate with the two control pods and the plurality of components of the all-electric blowout preventer stack via black channel communications.

2. The safety integrity level rated control system of claim 1, wherein the surface intervention system controller is configured to detect a user input created by one of the one or more buttons and to create a communication packet based, at least in part, on the user input.

3. The safety integrity level rated control system of claim 1, wherein the two remote terminal units further comprise a remote terminal unit controller.

4. The safety integrity level rated control system of claim 1, wherein the two remote terminal units comprise a second safety controller; and wherein the second safety controller is configured to communicate with the two control pods and the plurality of components of the all-electric blowout preventer stack via the black channel communications.

5. The safety integrity level rated control system of claim 1, wherein the one or more remote display panels are touchscreens.

6. The safety integrity level rated control system of claim 1, wherein the one or more buttons are connected via the surface control system and the subsea control system to one or more components of the all-electric blowout preventer stack.

7. The safety integrity level rated control system of claim 6, wherein the one or more components of the all-electric blowout preventer stack are selected from a group consisting of a blind shear ram, a casing shear ram, a LMRP connector, and an emergency disconnect.

8. The safety integrity level rated control system of claim 1, wherein the first safety integrity level network switch, the second safety integrity level network switch, and the first safety controller are configured to communicate via black channel communications in an emergency situation.

9. The safety integrity level rated control system of claim 1, wherein the two remote terminal units coupled to the LMRP section are configured to transmit communication packets to the two control pods coupled to the lower stack section.

10. A safety integrity level rated control system comprising:

a surface control system, comprising:

one or more remote display panels;

one or more buttons operatively connected to each of the one or more remote display panels;

two main controllers connected to the one or more remote display panels;

two junction boxes, each junction box connected to one of the two main controllers; and a surface intervention system controller connected to the one or more buttons via a wiring bus;

a subsea control system connected to the surface control system by one or more umbilicals extending from the two junction boxes, wherein the surface control system and the subsea control system are connected to an all-electric blowout preventer stack coupled to a subsea wellhead, and wherein the all-electric blowout preventer stack comprises a lower marine riser package (LMRP) section and a lower stack section;

a surface power system; and a subsea power system, comprising:

one or more lower stack battery packs comprising one or more batteries and a battery management system, each lower stack battery pack connected via a circuit to a plurality of components of the all-electric blowout preventer stack;

one or more LMRP battery packs comprising one or more batteries and a battery management system, each LMRP battery pack connected to the circuit; and a deadman and autoshear (DM/AS) battery pack, comprising one or more batteries and a battery management system, the DM/AS battery pack connected to the circuit.

11. The safety integrity level rated control system of claim 10, wherein the DM/AS battery pack is configured to provide power in deadman situations wherein there is no power to the subsea control system from the surface power system or in autoshear situations wherein the LMRP section is disconnected from the lower stack section when one or more blowout preventers in the lower stack section are open.

12. A safety integrity level rated control system comprising:

a surface control system, comprising:

one or more remote display panels;

one or more buttons operatively connected to each of the one or more remote display panels;

two main controllers connected to the one or more remote display panels;

two junction boxes, each junction box connected to one of the two main controllers; and a surface intervention system controller connected to the one or more buttons via a wiring bus;

a subsea control system connected to the surface control system by one or more umbilicals extending from the two junction boxes, wherein the surface control system and the subsea control system are connected to an all-electric blowout preventer stack coupled to a subsea wellhead, and wherein the all-electric blowout preventer stack comprising comprises a lower marine riser package (LMRP) section and a lower stack section; and an acoustic pod provided on the all-electric blowout preventer stack and in communication with the LMRP section and the lower stack section via black channel communications.

13. A method, comprising:

coupling a safety integrity level rated control system to an all-electric blowout preventer stack;

detecting, via a remote display panel, a failure in operation of a component of the all-electric blowout preventer stack;

pushing a button connected to the remote display panel, wherein pushing the button generates a command;

sending the command from a surface intervention system controller to a subsea control system;

receiving the command at a remote terminal unit coupled to a first section of the all-electric blowout preventer stack;

transmitting the command from the remote terminal unit to a control pod coupled to a second section of the all-electric blowout preventer stack;

transmitting the command to a safety integrity level network switch within the control pod;

transmitting the command from the safety integrity level network switch to a safety controller via black channel communications; and actuating the component based, at least in part, on the command.

14. The method of claim 13, further comprising overriding the failure in operation of the component.

15. The method of claim 13, wherein actuating the component comprises closing an open connector section of the second section of the all-electric blowout preventer stack.

16. A method, comprising:

coupling a safety integrity level rated control system to an all-electric blowout preventer stack, wherein the safety integrity level rated control system comprises a surface control system and a subsea control system;

creating a communication packet addressed to a component of the all-electric blowout preventer stack;

transmitting the communication packet through the surface control system and the subsea control system to the component;

detecting a failure of the component to actuate according to the communication packet;

transmitting a command to a remote terminal unit coupled to a first section of the all-electric blowout preventer stack;

transmitting the command from the remote terminal unit to a safety integrity level network switch within a control pod coupled to a second section of the all-electric blowout preventer stack;

transmitting the command from the safety integrity level network switch to a safety controller via black channel communications; and actuating the component based, at least in part, on the command.

17. The method of claim 16, further comprising overriding the failure of the component to actuate according to the communication packet.

18. The method of claim 16, wherein actuating the component comprises closing an open connector section of the all-electric blowout preventer stack.

* * * * *